US006332556B1

(12) United States Patent
Shalman

(10) Patent No.: US 6,332,556 B1
(45) Date of Patent: Dec. 25, 2001

(54) TRAY ASSEMBLY WITH SELECTIVELY ENGAGABLE SPLASH GUARD FOR PAINT ROLLER

(75) Inventor: Amnon Shalman, Kibbutz Gadot (IL)

(73) Assignee: Plasgad Plastic Products, Kibbutz Gadot (IL)

( * ) Notice: Subject to any disclaimer, the term of this patent is extended or adjusted under 35 U.S.C. 154(b) by 0 days.

(21) Appl. No.: 09/691,105

(22) Filed: Oct. 19, 2000

(51) Int. Cl.[7] ..... B05C 21/00
(52) U.S. Cl. ..... 220/570; 220/731; 220/700
(58) Field of Search ..... 220/570, 731, 220/699, 700

(56) References Cited

U.S. PATENT DOCUMENTS 4,164,299 * 8/1979 Zuhr ..... 220/570
5,103,999 * 4/1992 Elliott et al. ..... 220/570
5,553,701 * 9/1996 Jarecki et al. ..... 220/570
5,984,129 * 11/1999 Pasinski ..... 220/570
6,102,235 * 8/2000 Stern et al. ..... 220/570

* cited by examiner

*Primary Examiner*—Joseph M. Moy
(74) *Attorney, Agent, or Firm*—Mark M. Friedman

(57) ABSTRACT

A stackable tray assembly for paint rollers includes a tray formed with an inclined roller surface and a paint reservoir, the paint reservoir being partially bordered by a rear wall located opposite the inclined roller surface. The tray is preferably configured so as to allow nested stacking with a plurality of other similar trays. The assembly also includes a splash guard element configured for snap-on engagement with part of the tray so as to provide a splash guard overhanging part of the reservoir along substantially the entire length of the rear wall.

5 Claims, 4 Drawing Sheets

TRAY ASSEMBLY WITH SELECTIVELY ENGAGABLE SPLASH GUARD FOR PAINT ROLLER

FIELD AND BACKGROUND OF THE INVENTION

The present invention relates to paint trays for use with paint rollers and, in particular, it concerns a tray assembly with a selectively engagable splash guard.

It is known to provide a paint roller tray for use with a paint roller. Paint roller trays typically have an inclined roller surface sloping downwards into an adjacent paint reservoir or trough. In use, paint is poured into the reservoir and a paint roller is then dipped into the paint. The roller is then rolled against the inclined surface so as to distribute the paint evenly thereon prior to use. The inclined surface is typically inclined downwards towards the reservoir so that excess paint left on the surface drains back into the reservoir. Such trays are readily and cheaply manufactured by plastic injection molding as mass-produced items which may conveniently stacked in compact nested piles for storage and transportation.

A common problem associated with such trays is that of paint splashing while the roller is being dipped. Specifically, the aforementioned procedure of priming the roller with paint is typically performed by rolling the roller down and back up the inclined surface such that it repeatedly enters the reservoir. This backwards and forwards motion of the roller generates waves in the paint within the reservoir, giving rise to slopping of paint over the edges of the tray. A similar problem of paint spillage occurs during moving of the tray from one position to another. A splash guard cannot readily be added to such trays due to the requirements for nested stacking, and/or the limitations of simple, low-cost injection molding techniques.

There is therefore a need for a paint roller tray assembly which would provide a selectively engagable splash guard which would reduce the aforementioned problems of paint spillage while allowing the use of simple and cost effective injection molding manufacturing techniques, and/or which would not limit the ability of the tray to be nested for compact stacking during storage and transportation.

SUMMARY OF THE INVENTION

The present invention is a tray assembly for use with paint rollers.

According to the teachings of the present invention there is provided, a tray assembly with a selectively engagable splash guard for paint rollers comprising: (a) a tray formed with an inclined roller surface and a paint reservoir, the paint reservoir being partially bordered by a rear wall located opposite the inclined roller surface, the rear wall having a length; and (b) a splash guard element configured for snap-on engagement with part of the tray so as to provide a splash guard overhanging part of the reservoir along substantially the entire length of the rear wall.

According to a further feature of the present invention, the splash guard overhangs the reservoir by at least about 2 cm along substantially the entire length of the rear wall.

According to a further feature of the present invention, the tray is configured so as to allow nested stacking with a plurality of other similar trays.

According to a further feature of the present invention, the tray is formed from injection molded plastic.

According to a further feature of the present invention, the splash guard element is integrally formed with the tray in such a manner that the splash guard element is deployable between an open state in which the splash guard element does not overhang the reservoir, and a closed state in which the snapon engagement occurs between the splash guard element and the tray.

According to a further feature of the present invention, the splash guard element and the tray are interconnected by at least one integral hinge.

According to a further feature of the present invention, the splash guard element is formed with at least one recess configured to provide a receptacle when the splash guard element assumes the closed state.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1A:
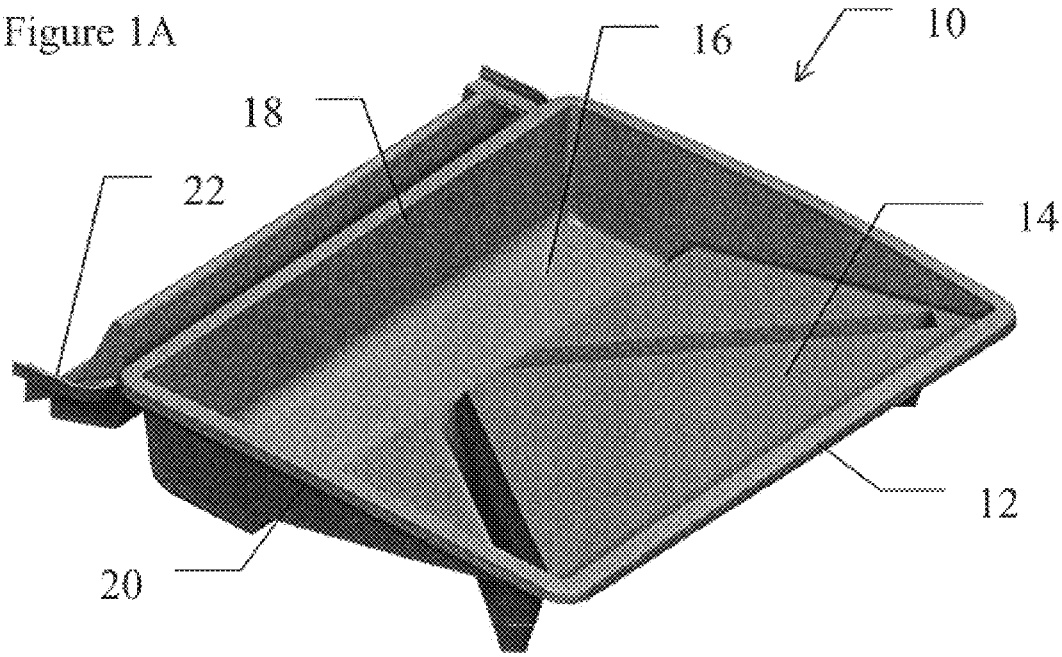
FIGS. 1A and 1B are schematic isometric views of a first implementation of a tray assembly, constructed and operative according to the teachings of the present invention, shown with a splash guard element deployed in an open state and a closed state, respectively.

The present invention is a tray assembly for use with paint rollers.

The principles and operation of tray assemblies according to the present invention may be better understood with reference to the drawings and the accompanying description.

Referring now to the drawings, FIGS. 1–4 show two implementations of a tray assembly, generally designated 10, constructed and operative according to the teachings of the present invention.

Generally speaking, tray assembly 10 includes a tray 12 formed with an inclined roller surface 14 and a paint reservoir 16. Paint reservoir 16 is partially bordered by a rear wall 18, located opposite inclined roller surface 14, which forms part of the wall 20 surrounding tray 12. Tray 12 is preferably configured so as to allow nested stacking (not shown) with a plurality of other similar trays. Assembly 10 also includes a splash guard element 22 configured for snap-on engagement with part of tray 12 so as to provide a splash guard overhanging part of reservoir 16 along substantially the entire length of rear wall 18. An overhang of at least about 5 mm has been found effective to breakup waves of paint, thereby greatly reducing problems of splashing. Preferably, the extent of the overhang is at least about 2 cm.

Preferably, tray 12 is formed from injection molded plastic. Although splash guard element 22 may optionally be implemented as a separable element, splash guard element 22 is more preferably integrally formed with tray 12 in such a manner that the splash guard element is deployable between an open state (FIGS. 1A, 2A and 3A) in which the splash guard element does not overhang the reservoir, thereby allowing nested stacking of the tray with other similar trays, and a closed state (FIGS. 1B, 2B and 3B) in which the snap-on engagement occurs between splash guard element 22 and tray 12. It will be noted in this context that the engagement referred to herein may be engagement of a part of the splash guard with a part of the tray, and does not imply that the elements were completely separate prior to the engagement.

In the case of an integrally formed injection molded assembly, splash guard element 22 and tray 12 may advantageously be formed such that they are interconnected by at least one integral hinge.

Figure 1B:
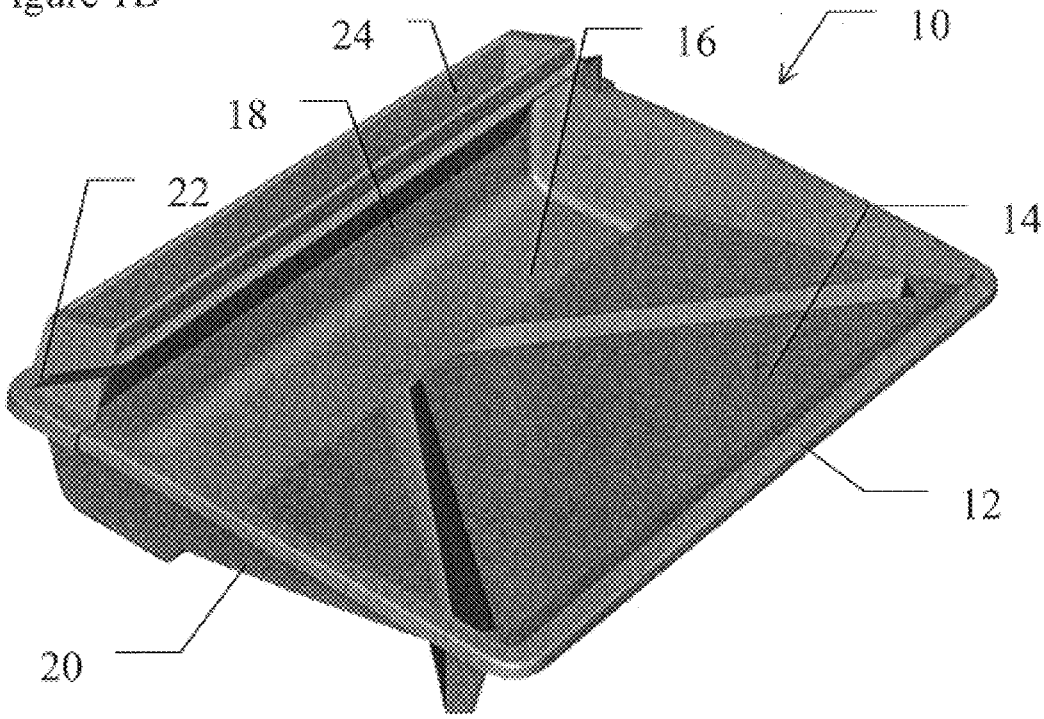
Figure 2A:
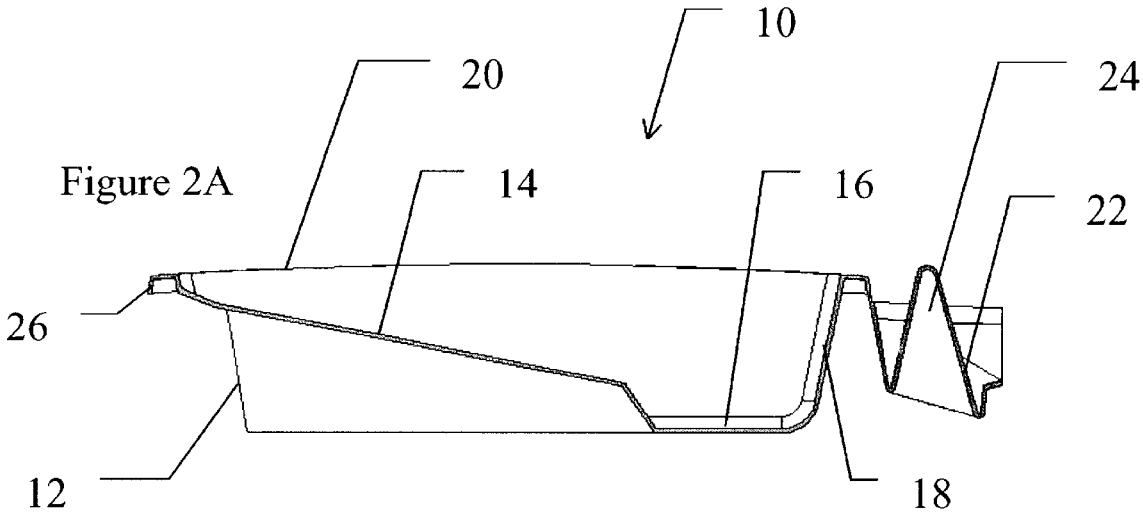
FIGS. 2A and 2B are side cross-sectional views taken through the first implementation of the present invention illustrating the states of FIGS. 1A and 1B, respectively.
Figure 2B:
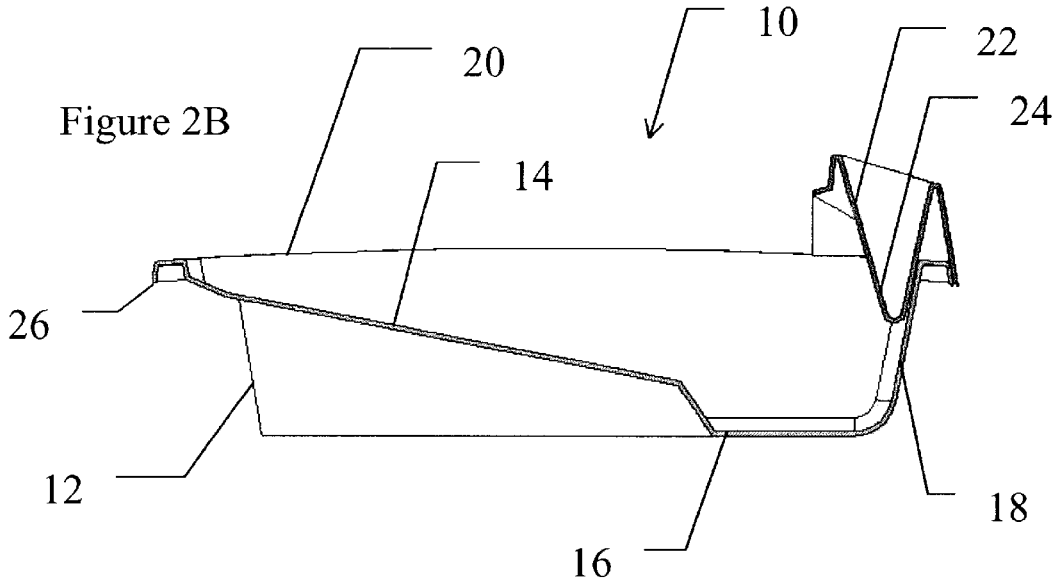
Figure 3A:
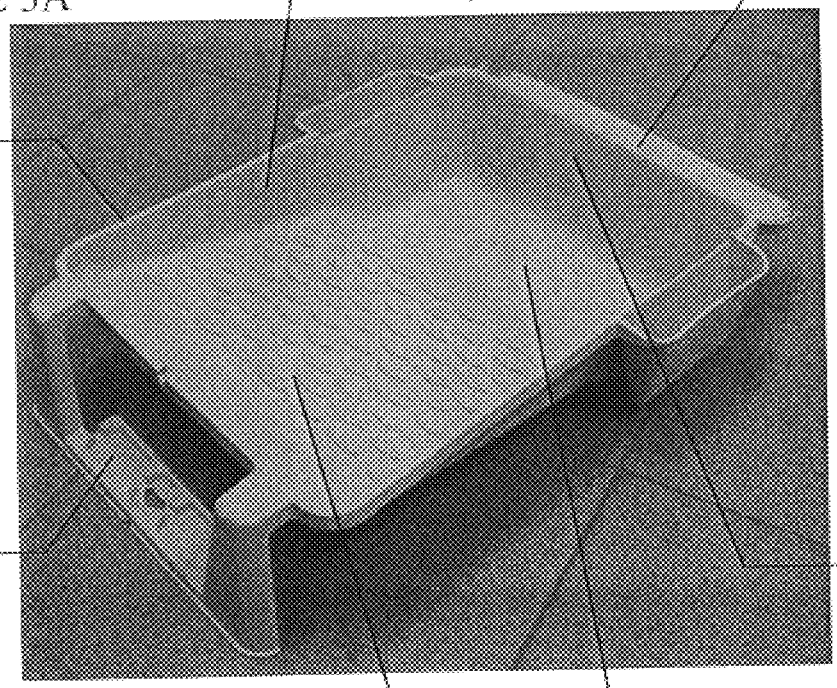
FIGS. 3A and 3B are schematic isometric views of a second implementation of a tray assembly, constructed and operative according to the teachings of the present invention, shown with a splash guard element deployed in an open state and a closed state, respectively.
Figure 3B:
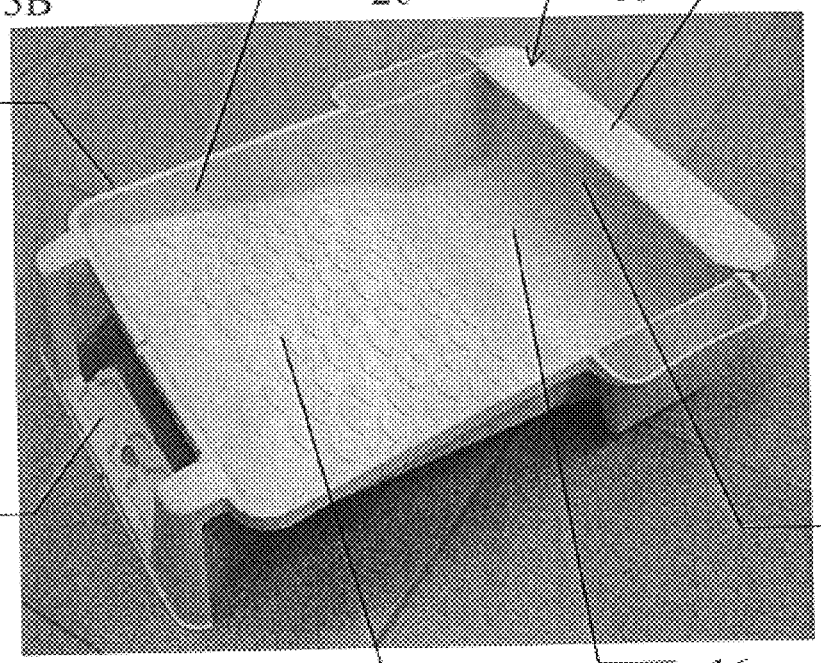

Referring briefly specifically to FIGS. 1A, 2A, 1B and 2B, this implementation illustrates a further preferred optional feature according to which splash guard element 22 is formed with at least one recess 24 configured to provide a receptacle when the splash guard element assumes the closed state of FIGS. 1B and 1C. Such a receptacle is frequently useful for temporarily housing additional tools (such as paint brushes) which may be required intermittently during use of tray assembly 10. Alternatively, the receptacle may serve as a roller rest for supporting a paint roller while not in use. Particularly in the latter case, it is generally preferable to provide drainage holes for permitting drainage of any drips of paint back into the reservoir. FIGS. 3A and 3B illustrate an option without this recessed feature.

Figure 4:
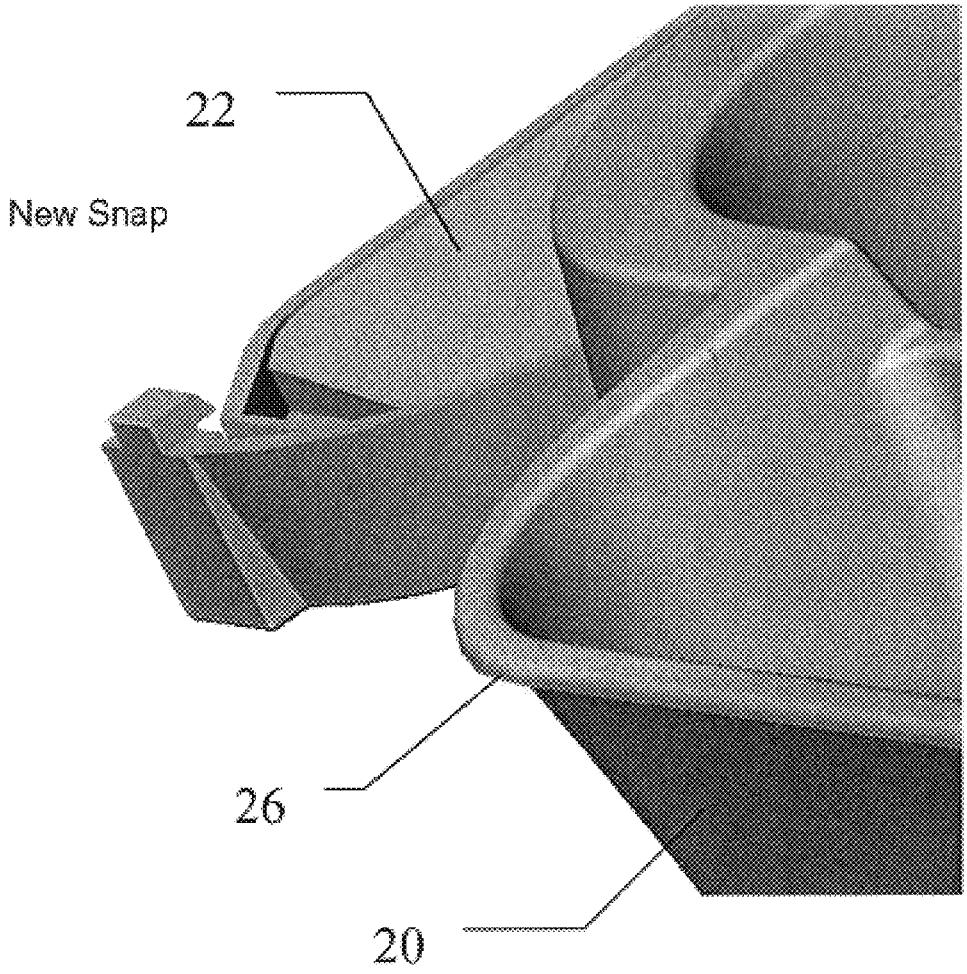
FIG. 4 is an enlarged isometric view of a snap-on catch configuration from the implementation of FIG. 3A.

Finally, turning briefly to FIG. 4, there is shown a detailed view of one preferred implementation of the snap-on engagement between splash guard element 22 and tray 12. In the example shown, tray 12 features a simple continuous ledge 26 around the rim of wall 20, while the ends of splash guard element 22 are configured to provide a snap-on configuration in a manner which is well known in the art. Clearly, this configuration may readily be replaced by a wide range of alternative snap-locking configurations which are within the capabilities of one ordinarily skilled in the art.

It will be appreciated that the above descriptions are intended only to serve as examples, and that many other embodiments are possible within the spirit and the scope of the present invention.

What is claimed is:

1. A tray assembly with a selectively engagable splash guard for paint rollers comprising:

(a) a tray formed with an inclined roller surface and a paint reservoir, said paint reservoir being partially bordered by a rear wall located opposite said inclined roller surface, said rear wall having a length; and (b) a splash guard element configured for snap-on engagement with part of said tray so as to provide a splash guard overhanging part of said reservoir along substantially the entire length of said rear wall, wherein said splash guard element is integrally formed with said tray by injection molding in such a manner that said splash guard element is deployable between an open state in which said splash guard element does not overhang said reservoir, and a closed state in which said snap-on engagement occurs between said splash guard element and said tray, and wherein said splash guard element and said tray are interconnected by at least one integral hinge.

2. The tray assembly of claim 1, wherein said splash guard overhangs said reservoir by at least about 2 cm along substantially the entire length of said rear wall.

3. The tray assembly of claim 1, wherein said tray is configured so as to allow nested stacking with a plurality of other similar trays.

4. The tray assembly of claim 1, wherein said splash guard element is formed with at least one recess configured to provide a receptacle when said splash guard element assumes said closed state.

5. A tray assembly with a selectively engagable splash guard for paint rollers comprising:

(a) a tray formed with an inclined roller surface and a paint reservoir, said paint reservoir being partially bordered by a rear wall located opposite said inclined roller surface, said rear wall having a length; and (b) a splash guard element configured for snap-on engagement with part of said tray so as to provide a splash guard overhanging part of said reservoir along substantially the entire length of said rear wall, wherein said splash guard element is integrally formed with said tray by injection molding in such a manner that said splash guard element is deployable between an open state in which said splash guard element does not overhang said reservoir, and a closed state in which said snap-on engagement occurs between said splash guard element and said tray, and wherein said splash guard element is formed with at least one recess configured to provide a receptacle when said splash guard element assumes said closed state.

* * * * *